US008104847B2

(12) United States Patent
Colon et al.

(10) Patent No.: US 8,104,847 B2
(45) Date of Patent: Jan. 31, 2012

(54) APPARATUS FOR STORING AND DISPENSING ROLLED CLEANING WIPES

(76) Inventors: Ana Colon, Maunabo, PR (US); Julissa Santiago, Central Islip, NY (US)

( * ) Notice: Subject to any disclaimer, the term of this patent is extended or adjusted under 35 U.S.C. 154(b) by 600 days.

(21) Appl. No.: 12/205,863

(22) Filed: Sep. 6, 2008

(65) Prior Publication Data

US 2009/0066201 A1 Mar. 12, 2009

Related U.S. Application Data

(60) Provisional application No. 60/967,592, filed on Sep. 6, 2007.

(51) Int. Cl.
*B65H 19/00* (2006.01)

(52) U.S. Cl. ..... 312/34.8; 242/598.5

(58) Field of Classification Search ..... 312/34.8, 312/34.24, 242; 242/598, 598.3, 598.5, 598.6
See application file for complete search history.

(56) References Cited

U.S. PATENT DOCUMENTS 2,215,053 A * 9/1940 Reese ..... 242/598.3
2,462,776 A * 2/1949 Price ..... 225/33
4,089,481 A * 5/1978 Ciuci ..... 242/564.4
4,408,811 A * 10/1983 Richardson et al. ..... 312/34.4
4,483,491 A * 11/1984 Rainey ..... 242/598.3
5,172,966 A * 12/1992 Myatt ..... 312/34.8
5,660,313 A * 8/1997 Newbold ..... 225/42
5,697,577 A * 12/1997 Ogden ..... 242/598.6
5,897,074 A * 4/1999 Marino ..... 242/594.1
6,056,233 A * 5/2000 Von Schenk ..... 242/594.5
6,098,836 A * 8/2000 Gottselig ..... 221/45
6,446,808 B1 * 9/2002 Paul et al. ..... 206/494
6,505,748 B2 * 1/2003 Ward ..... 211/85.5
6,536,707 B2 * 3/2003 Adelakun ..... 242/598.6
6,902,134 B2 * 6/2005 Green et al. ..... 242/598.3
7,395,986 B1 * 7/2008 Haering ..... 242/599.3
2002/0171003 A1 * 11/2002 Johnson et al. ..... 242/598.3
2007/0080256 A1 * 4/2007 Collins ..... 242/598.6
2007/0221778 A1 * 9/2007 Gullo ..... 242/598.6
2009/0066201 A1 * 3/2009 Colon et al. ..... 312/35

* cited by examiner

*Primary Examiner* — Janet M Wilkens
*Assistant Examiner* — Daniel Rohrhoff
(74) *Attorney, Agent, or Firm* — Hoglund & Pamias, PSC; Roberto J. Rios

(57) ABSTRACT

A storage and dispensing arrangement is provided to maintain moistened wipes wet. The moistened wipes are rolled around a core tube and placed inside a first housing. The first housing is then placed inside a second housing having a closing door to isolate the first housing from external environment. The unit is then hanged into a stand, a rack or a wall.

17 Claims, 5 Drawing Sheets

APPARATUS FOR STORING AND DISPENSING ROLLED CLEANING WIPES

FIELD OF THE INVENTION

This invention relates to the use of wet or moistened wipes and more specifically a system to store and dispense such wipes.

BACKGROUND OF THE INVENTION

Toilet paper is commonly used to clean the rectum after having a bowel movement. Since this process deals with the handling of human feces, it is easy for an individual's hands to become contaminated from the feces. Failure to properly clean the contaminated hands, such as by washing with soap and hot water, can easily result in the transfer of contamination. This problem is especially important with respect to individuals involved in public service. For example, failure of restaurant employees to clean their hands after going the bathroom can result in contamination of the food being served. Likewise, failure of medical practitioners to properly clean their hands can result in transferring bacteria to patients.

Conventional toilet paper is a dry, loosely woven, fibrous material that easily decomposes in water. This is to help insure that the toilet paper easily flushes in the toilet. Toilet paper is predominately wood fibers and, as such, does not work to disinfect the user's hands. Rather, toilet paper is used to limit contact of the hands with the feces. One problem often encountered with toilet paper is that it can be abrasive to the walls of the rectum. This is especially true for infants who often obtain rashes. The problem is also encountered in adults who can suffer from chafing or the irritation of hemorrhoids. One approach for remedying this problem in infants has been to use pre-moistened tissues. Such tissues typically come in a separate dispenser. The added moisture helps to soften the paper and make it easier to clean the infant.

There are various kinds of dispensers already known which are intended, for example, for use in kitchens, toilets, or hospitals and comprise containers for receiving wrapping paper, toilet or toweling paper. None of these containers is, however, suitable for receiving moistened rolled wipes which is already saturated with a liquid, since it is not closed airtight toward the outside and the liquid would evaporate from the moist roll within the container. Furthermore, these containers are usually neither provided with supporting means which insure that the respective container is held static nor are configured as portable units.

Thus, what is needed is a novel wipes storage/dispensing arrangement that overcomes the above-explained problems in an economic and efficient manner.

SUMMARY OF THE INVENTION

According to one aspect of the invention, a storage and dispensing arrangement includes a plurality of cleaning elements rolled around a linear core element. Both ends of said core element protrude from said plurality of cleaning elements. A first housing has at least one opening and at least one lid and said plurality of cleaning elements is positioned within said first housing. An access aperture is selectively positioned along a surface periphery of said first housing and configured to allow retrieval of said plurality of cleaning elements. The at least one lid comprises a pass-through opening configured to receive and allow the ends of said core element to protrude from said first housing.

According to a further aspect of the invention, a second housing is provided having at least one opening, one door and an interior receiving area defined at least by two opposing walls, each wall comprising a guiding aperture. The second housing is configured to receive said first housing within said interior receiving area through its at least one opening. The guiding apertures are configured to slidably receive said ends of said core element allowing said ends of said core element to protrude from said second housing. The second housing is closed by means of said at least one door sealing the first housing from an external environment. The at least one door comprises one of: a hinged door and a sliding door. A cutting element is provided positioned about the surface periphery of said second housing and configured to selectively cut said plurality of cleaning elements at desired lengths. The ends of said core element rotate in place within a portion of said guiding apertures when said plurality of cleaning elements is being retrieved. The second housing further includes an attaching arrangement selectively positioned to fix said second housing to a surface.

According to further aspects of the invention, a floor pedestal apparatus includes the storage and dispensing arrangement according to the invention. A rack and cabinet arrangement also includes the storage and dispensing arrangement of the invention. The rack and cabinet arrangement includes a first area having at least one of: an open area, a closing door, and a shelf. A second area includes at least one receiving portion configured to receive the ends of said core element to securely allow rotation of said core element when the plurality of cleaning elements are being retrieved. An engaging element is provided and configured to receive a second plurality of cleaning elements. The plurality of cleaning elements can be selected from at least one of: paper towel, toilet paper, moistened wipes, and napkins. The storage and dispensing arrangement of the invention includes a glow-in-dark material.

BRIEF DESCRIPTION OF THE DRAWINGS

The features and advantages of the present invention will become more clearly apparent from the following detailed description thereof which is to be read with reference to the accompanying drawings, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

Figure 1:
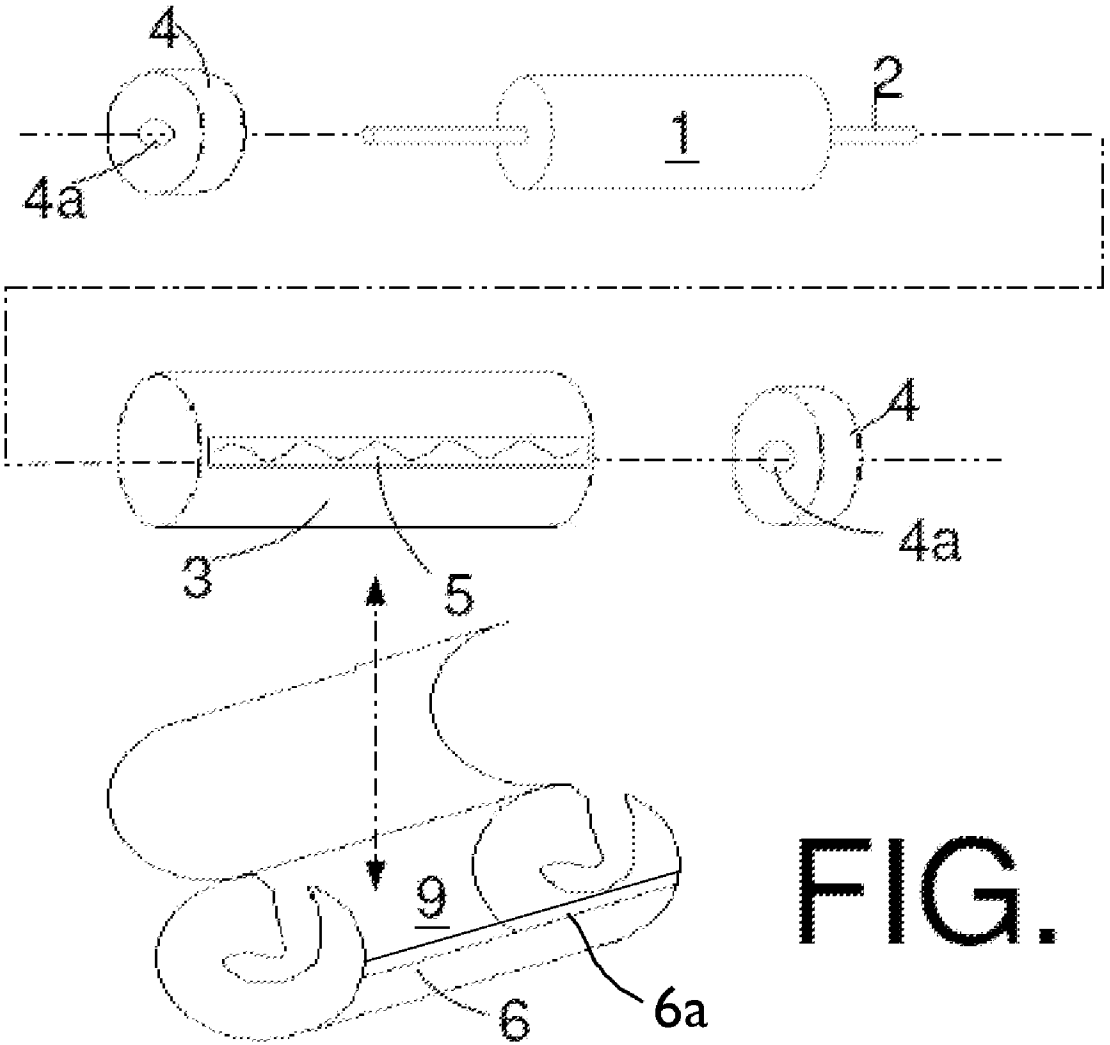
FIG. 1 shows an exploded view of a storage arrangement according to an embodiment of the invention.
Figure 2:
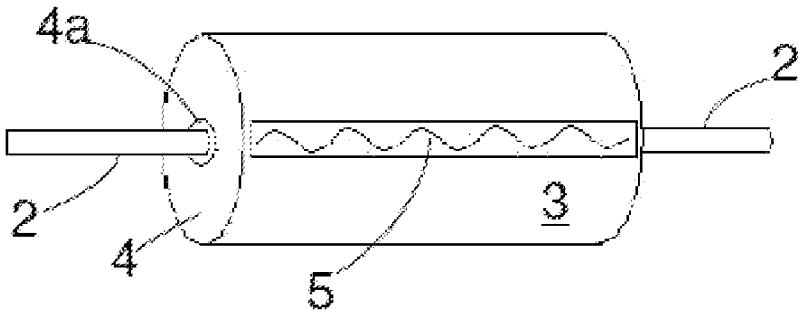
FIG. 2 shows a perspective view of an assembled first housing according to an embodiment of the invention.
Figure 3:
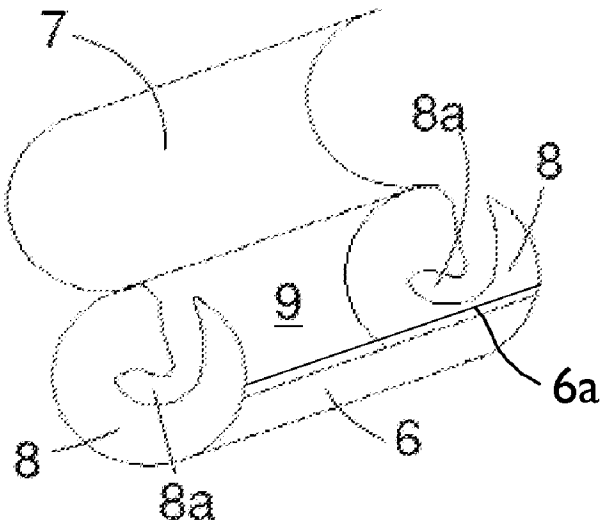
FIG. 3 shows a perspective view of a second housing according to an embodiment of the invention.
Figure 4:
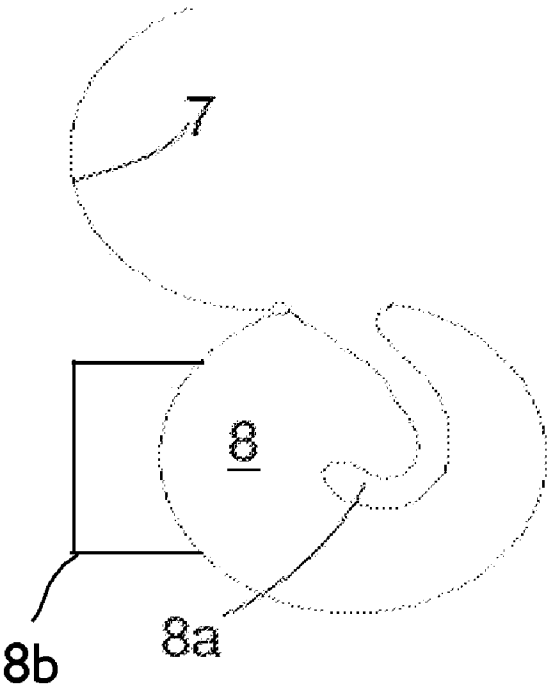
FIG. 4 shows a side view of a second housing according to an embodiment of the invention.

The dispensing assembly according to the invention will be described in conjunction with FIGS. 1-3. A plurality of wipes 1 is selectively rolled around a holding rod 2. In order to prevent said moistened wipes from drying a first housing 3 is provided comprising a hollow container having two opened ends for receiving each a lid 4. Once the plurality of wipes 1 is slide into said first housing 3, the two ends of said holding rod 2 protrude from said first housing by means of openings 4*a* provided on each lid 4 as shown in FIG. 1. The first housing 3 is also provided with an opening 5 to allow ease of access and usage of said wipes 1. A second housing 6 have an upper opening and comprises an inner hollow portion 9 as defined by two end walls 8. Each end wall 8 comprises a guiding opening portion 8*a* as illustrated in FIG. 3. An access door 7 is selectively provided to access said inner hollow portion 9. In an embodiment of the invention, said access door 7 comprises a hinged door as shown in FIG. 4. However, it is also envisioned that said access door 7 could be a sliding door, sliding about the periphery (inner or outer) of said second housing 6. Additionally, a self-return biasing means such as but not limited to: a spring can be provided to bias said door to return to its original closed position. A cutting element 6*a* could also be selectively positioned on said second housing 6 as a cutting means for the wipes 1. In addition, a back surface of said second housing could be provided with a plurality of holes so that it could be screwed against a surface such as a wall. Alternatively, other fastening means could be used to attach the unit to a surface. It is also envisioned that the dispensing assembly could be provided with a glowing coating or material to allow the assembly to glow in the dark. The assembly can be made of any suitable lightweight rigid material such as but not limited to: plastic, polymer, wood, stainless steel or any combination thereof.

Figure 5:
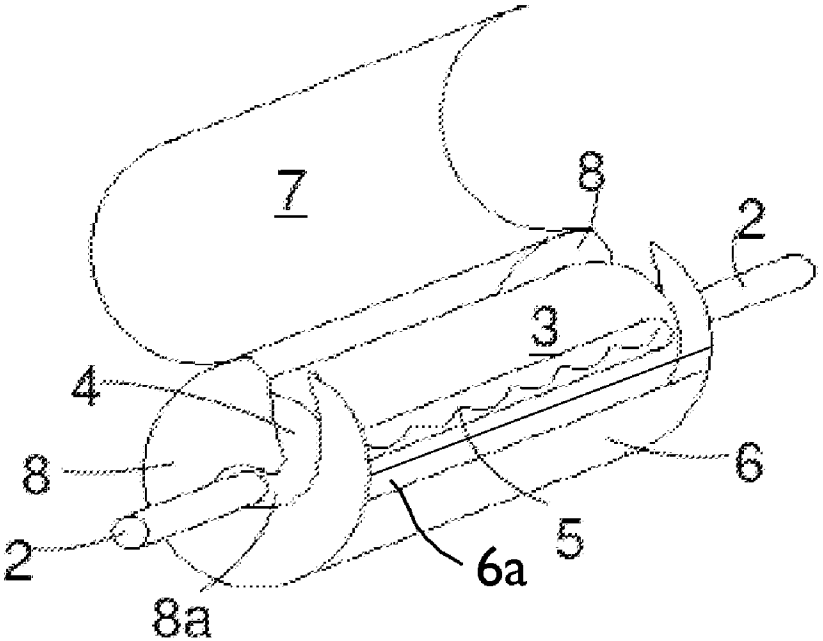
FIG. 5 shows a perspective view of an assembled storage arrangement according to an embodiment of the invention.
Figure 6:
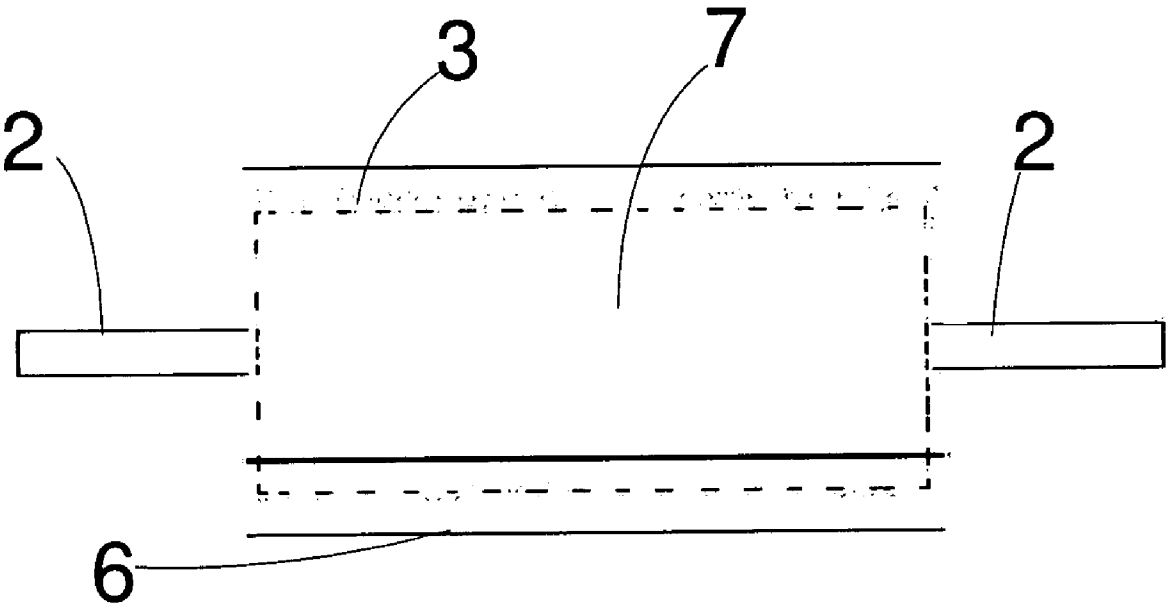
FIG. 6 shows a front view of an assembled storage arrangement according to an embodiment of the invention.

Installation and operation of the system will now be explained in accordance to the FIGS. 1-7. The moistened wipes 1 are either rolled around said holding rod 2 or alternatively it could be acquired as a single pre-assembled unit. In either case, a user would insert the unit 1 into a side opening of said first housing 3 and then close each side of said first housing 3 by means of the lids 4 ensuring that the ends of said holding rod 2 are inserted throughout the openings 4*a* so that said ends protrude from said first housing 3 as shown in FIG. 2. A threaded arrangement could be provided between the lids 4 and the side openings to removably close the first housing 3. Alternatively, other means such as but not limited to: friction fit, and snap-on, could be used to provide proper closing of said first housing 3. In addition, a sealing arrangement could be provided to maintain the first housing's interior humid and wet. Thus, an O-ring or any other equivalent could be provided between the side openings and the lids 4. Next, the first housing 3 would be placed within the inner hollow portion 9 of said second housing 6 as shown in FIG. 5. It is important to note that a guiding opening portion 8*a* is provided on each wall 8 for inserting said holding rod 2 and allow them to protrude from said second housing 6. Finally, a door 7 is closed and the unit would be ready for installation. For installing the unit to a wall surface, a flat back supporting portion 8*b* including fastening means such as but not limited to: holes and screws is provided on a back portion of the second housing 6. Alternative, the unit could be removably hanged on any structure such as but not limited to: a floor stand, a rack, and a conventional toilet tissue holder arrangement by providing receiving means designed to receive at least one end of said holding rod 2.

In operation, an individual would open the door 7, reach the wipes 1 within the opening 5, grab and pull the desired amount of wipes 1. In one embodiment, the cutting element provided is used to cut the wipes at a desired length. In another embodiment, the rolled wipes come pre-cut at specific length intervals. Once the individual is done, the door 7 will be closed to ensure maintaining the wipes moistened and wet for prolonged period of times.

Figure 8:
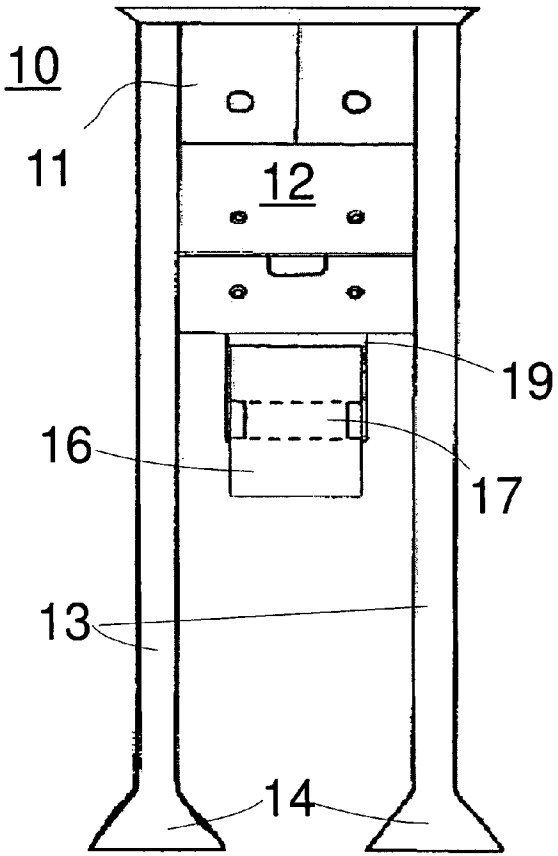
FIG. 8 shows a front view of a rack assembly according to an embodiment of the invention.
Figure 7:
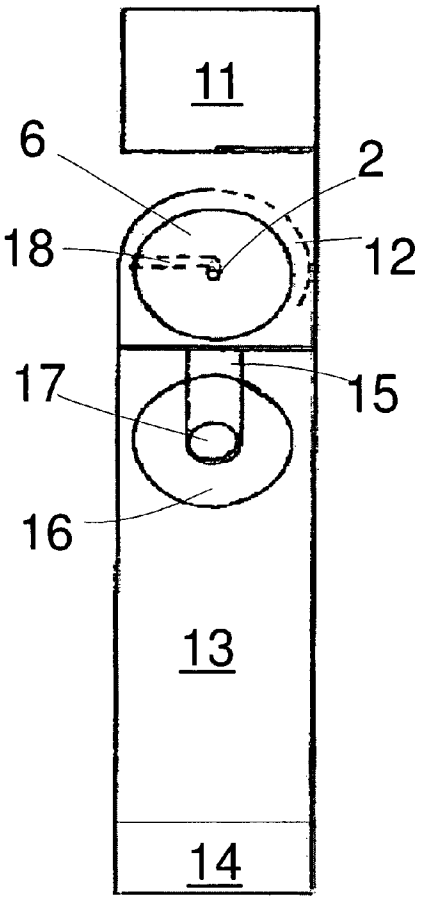
FIG. 7 shows a side view of a rack assembly according to an embodiment of the invention.

A rack assembly according to one embodiment of the invention will be described in accordance to FIGS. 7 and 8. A rack assembly 10 comprises a storage compartment 11 having doors. However, the storage compartment 11 could be an open area and have further shelving means therein. A second storage compartment 12 is provided to allow storage of the second housing 6 of the present invention. A guiding portion 18 provided on each side of the compartment 12 receives an end of said holding rod 2 until it reaches a latching portion removably securing said holding rod 2 in place while in use. The latching portion is configured to allow rotation of said holding rod 2 when the wipes are being pulled. Doors could also be provided to restrict access to said wipe unit. A holding element 19 is provided to securely hold a conventional toilet paper roll 16. Holding elements 19 comprise an engaging portion configured to mate with each end of the toilet paper central tube 17. In the preferred embodiment, rack assembly 10 is a floor standing assembly with supporting legs 13 and base elements 14. However, it is also envisioned that the rack assembly 10 could be a wall mounted assembly or have one or more legs/base elements.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense. This specification and the accompanying drawings disclosed several preferred embodiments as examples of the invention. The invention is not intended to be limited to the embodiments illustrated. Numerous modifications, changes, variations, substitutions and equivalents will be apparent to those skilled in the art without departing from the spirit and scope of the present invention as described in the claims.

We claim:

1. A storage and dispensing arrangement comprising: a plurality of cleaning elements rolled around a linear core element, wherein both ends of said core element protrudes from said plurality of cleaning elements; a first housing having at least one opening and at least one lid comprising a pass-through opening configured to receive and allow the ends of said core element to protrude from said first housing, wherein said plurality of cleaning elements is positioned within said first housing; a second housing having at least one opening, one door and an interior receiving area wherein said interior receiving area is defined at least by two opposing walls, each wall comprising a guiding aperture.

2. The storage and dispensing arrangement of claim 1 further comprising: an access aperture selectively positioned along a surface periphery of said first housing and configured to allow retrieval of said plurality of cleaning elements.

3. The storage and dispensing arrangement of claim 1, wherein said first housing comprises two openings and two lids.

4. The storage and dispensing arrangement of claim 1, wherein said second housing is configured to receive said first housing within said interior receiving area through its at least one opening.

5. The storage and dispensing arrangement of claim 4, wherein said guiding apertures are configured to slidably receive said ends of said core element allowing said ends of said core element to protrude from said second housing.

6. The storage and dispensing arrangement of claim 5, wherein said second housing is closed by means of said at least one door sealing the first housing from an external environment.

7. The storage and dispensing arrangement of claim 6, wherein said at least one door comprises one of: a hinged door and a sliding door.

8. The storage and dispensing arrangement of claim 7, further comprising a cutting element positioned about the surface periphery of said second housing and configured to selectively cut said plurality of cleaning elements at desired lengths.

9. The storage and dispensing arrangement of claim 5, wherein said ends of said core element rotate in place within a portion of said guiding apertures when said plurality of cleaning elements are being retrieved.

10. The storage and dispensing arrangement of claim 1, wherein said second housing further comprises: an attaching arrangement selectively positioned to fix said second housing to a surface.

11. The storage and dispensing arrangement of claim 1, wherein said plurality of cleaning elements comprises at least one of: paper towel, toilet paper, moistened wipes, and napkins.

12. The storage and dispensing arrangement of claim 1, wherein said arrangement comprises a glow-in-dark material.

13. A floor pedestal apparatus comprising the storage and dispensing arrangement of claim 1.

14. A rack and cabinet arrangement comprising the storage and dispensing arrangement of claim 1.

15. The rack and cabinet arrangement of claim 14 further comprising: a first area comprising at least one of: an open area, a closing door, and a shelf.

16. The rack and cabinet arrangement of claim 14 further comprising: a second area comprising at least one receiving portion configured to receive the ends of said core element to securely allow rotation of said core element when the plurality of cleaning elements are being retrieved.

17. The rack and cabinet arrangement of claim 14 further comprising: an engaging element configured to receive a second plurality of cleaning elements.

* * * * *